US007796901B2

(12) United States Patent
Hanamoto et al.

(10) Patent No.: US 7,796,901 B2
(45) Date of Patent: Sep. 14, 2010

(54) IMAGE FORMING APPARATUS, AND UNIT REMOVABLY INSTALLED IN AN IMAGE FORMING APPARATUS

(75) Inventors: Hidetoshi Hanamoto, Suntou-gun (JP); Yoshitaka Kokubo, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 12/047,730

(22) Filed: Mar. 13, 2008

(65) Prior Publication Data

US 2008/0240750 A1 Oct. 2, 2008

(30) Foreign Application Priority Data

Mar. 29, 2007 (JP) ..... 2007-089049
Mar. 6, 2008 (JP) ..... 2008-056627

(51) Int. Cl.
*G03G 15/00* (2006.01)
*G03G 15/20* (2006.01)
*G03G 15/08* (2006.01)
*G03G 15/01* (2006.01)

(52) U.S. Cl. ..... 399/45; 399/38; 399/69; 399/121; 399/302

(58) Field of Classification Search ..... 399/45, 399/69, 121, 302
See application file for complete search history.

(56) References Cited

U.S. PATENT DOCUMENTS 6,668,144 B2 12/2003 Maruyama
6,748,182 B2 * 6/2004 Yoshida et al. ..... 399/12
2002/0071688 A1 6/2002 Maruyama
2004/0126125 A1 * 7/2004 Yoda et al. ..... 399/45
2005/0058456 A1 * 3/2005 Yoo ..... 398/140
2005/0276198 A1 * 12/2005 Kokubo ..... 369/53.22
2006/0222391 A1 * 10/2006 Choi ..... 399/66
2007/0120945 A1 5/2007 Akita et al. ..... 347/224

FOREIGN PATENT DOCUMENTS

JP 6-83144 3/1994
JP 2001-139189 5/2001
JP 2002-182518 6/2002
JP 2008134440 A * 6/2008

* cited by examiner

*Primary Examiner*—David M Gray
*Assistant Examiner*—Francis Gray
(74) *Attorney, Agent, or Firm*—Fitzpatrick, Cella, Harper & Scinto

(57) ABSTRACT

An image forming apparatus includes a controller which sets fixing conditions in a fixing unit in accordance with the type of printing medium sensed by a sensor. An intermediate transfer member and sensor are configured as an intermediate transfer member unit. The intermediate transfer member unit is removably installed in the main body of the image forming apparatus. The intermediate transfer member unit has a storage unit which stores information used to determine the type printing medium by the sensor.

8 Claims, 14 Drawing Sheets

FIG. 7

EEPROM

| |
|---|
| REFERENCE PAPER (SPECULAR REFLECTION) LIGHT-EMISSION LIGHT QUANTITY $L_{SR}$ |
| REFERENCE PAPER (DIFFUSE REFLECTION) LIGHT-EMISSION LIGHT QUANTITY $L_{DR}$ |
| GLOSSINESS DISCRIMINATION THRESHOLD VALUE Ta1 |
| GLOSSINESS DISCRIMINATION THRESHOLD VALUE Ta2 |
| SENSOR INITIAL OUTPUT VALUE (SPECULAR REFLECTION) $C_{IA}$ |
| SENSOR INITIAL OUTPUT VALUE (DIFFUSE REFLECTION) $C_{IB}$ |
| ⋮ |
| ⋮ |

FIG. 11

| RATIO OF SPECULAR-REFLECTION OUTPUT TO DIFFUSE-REFLECTION OUTPUT | RESISTANCE VALUE |
|---|---|
| 1 | 0 |
| 2 | 0.5 |
| 3 | 1 |
| 4 | 1.5 |

IMAGE FORMING APPARATUS, AND UNIT REMOVABLY INSTALLED IN AN IMAGE FORMING APPARATUS

BACKGROUND OF THE INVENTION

1. Field of the Invention

The present invention relates to an image forming apparatus and to a unit removably installed in an image forming apparatus.

2. Description of the Related Art

In an image forming apparatus such as a copier or laser printer, it is preferred that image forming conditions be changed in accordance with the type of printing medium. There are various types of printing media, examples of which are plain paper, glossy paper, rough paper, thick paper, thin paper, OHT (overhead transparency) and the like. Preferably, the quality of the image formed on the printing medium is stabilized by setting image forming conditions in accordance with these types. For example, the size and type (also referred to as "type of paper" hereafter) of the printing medium is set by a user at a control panel, or the like, provided on the main body of the image forming apparatus, and fixing process conditions (e.g., fixing temperature and conveyance speed of the printing medium that passes by the fixing unit) are controlled in accordance with these settings.

It has been proposed to provide a printing-medium determination sensor within an image forming apparatus for the purpose of eliminating the task of having the user input the type of printing medium (see the specification of Japanese Patent Laid-Open No. 2002-182518). In accordance with this proposal, the type of printing medium is determined by sensing an image on the surface of the printing medium using a CMOS sensor, and the image forming conditions (e.g., developing conditions and transfer conditions or fixing conditions) are controlled so as to be changed.

Furthermore, an apparatus has been proposed in which a light source is provided at a position opposing a sensor which, by detecting transmitted light from the printing medium, determines the type of printing medium and the thickness of the printing medium (see the specification of Japanese Patent Laid-Open No. 2001-139189).

A problem with the techniques described above is that if paper dust or toner, or the like, attaches itself to the surface of the LED or sensor due to repetition of image formation, type and thickness will be determined erroneously. In order to solve this problem, a method of mitigating the effects of adhered paper dust and toner, etc., by correcting (or calibrating) the output of a reflective-type optical sensor using a corrective plate has been considered.

However, in a case where an image forming apparatus is used over a prolonged period of time or a case where a large quantity of printing (image formation) is performed, it is highly likely that paper dust or toner will affix itself to the surface of the LED or sensor in a reflective-type optical sensor to such an extent that the contamination will exceed a fixed level. In other words, it may be assumed that determination accuracy will decline even if the sensor output is corrected. For example, in the case of an apparatus in which the image forming speed is high (the number of sheets on which images are formed per unit time is large), it is highly likely that a large amount of image formation will be performed over a long period of time. Moreover, a large number of sheets of the printing medium are conveyed in a high-speed apparatus. As a result, it is highly likely that paper dust will attach itself to the surface of the LED or sensor.

Further, consideration has been given to adopting an arrangement in which paper dust or toner that has attached itself to the surface of a reflective-type optical sensor is removed (cleaned off) by the user. In this case, however, labor to remove the paper dust or toner is required of the user. Further, it is necessary to adopt an arrangement in which the user is capable of accessing the reflective-type optical sensor. There is the danger that this will lead to an increase in the size of the apparatus.

SUMMARY OF THE INVENTION

Accordingly, the present invention seeks to solve at least one of these and other problems. For example, the present invention seeks to provide an image forming apparatus in which the accuracy with which the type of printing medium is determined is capable of being maintained even in a case where the image forming apparatus is used over a long period of time. Other problems will be understood from the entirety of the specification.

An image forming apparatus according to the present invention comprises: a sensor which senses a type of printing medium; an image forming unit which forms an image on an image carrier; an intermediate transfer member to which the image that has been formed on the image carrier is transferred by primary transfer; a secondary transfer member which transfers the image that has been formed on the intermediate transfer member to the printing medium by secondary transfer; a fixing unit which fixes the image to the printing medium by applying heat and pressure to the printing medium to which the image has been transferred by secondary transfer; and a controller which sets fixing conditions in the fixing unit in accordance with the type of printing medium sensed by the sensor. The intermediate transfer member and sensor are configured as an intermediate transfer member unit. The intermediate transfer member unit is removably installed in the main body of the image forming apparatus. The intermediate transfer member unit has a storage unit which stores information used to determine the type printing medium by the sensor.

Further, a unit according to the present invention is a unit removably installed in an image forming apparatus. The unit comprises: an intermediate transfer member to which an image that has been formed on an image carrier is transferred by primary transfer; a sensor which senses the type of the printing medium; and a storage unit which stores information for determining the type of printing medium by the sensor.

In accordance with the present invention, the accuracy with which the type of printing medium is determined can be maintained even in a case where the image forming apparatus is used over a long period of time or a case where a large amount of image formation is carried out.

Further features of the present invention will become apparent from the following description of exemplary embodiments with reference to the attached drawings.

BRIEF DESCRIPTION OF THE DRAWINGS

FIG. 7 is a diagram illustrating an example of a memory map of a memory with which the intermediate transfer member unit is equipped;

FIG. 11 is a diagram illustrating the relationship between threshold values and resistance values for determining types of printing media according to an embodiment;

DESCRIPTION OF THE EMBODIMENTS

Embodiments of the present invention will be illustrated below. The individual embodiments described below will be useful in order to understand various concepts of the present invention, such as broader, intermediate and narrower concepts thereof. Further, the technical scope of the present invention is determined by the scope of the claims and is not limited by the individual embodiments set forth below.

First Embodiment

Figure 1:
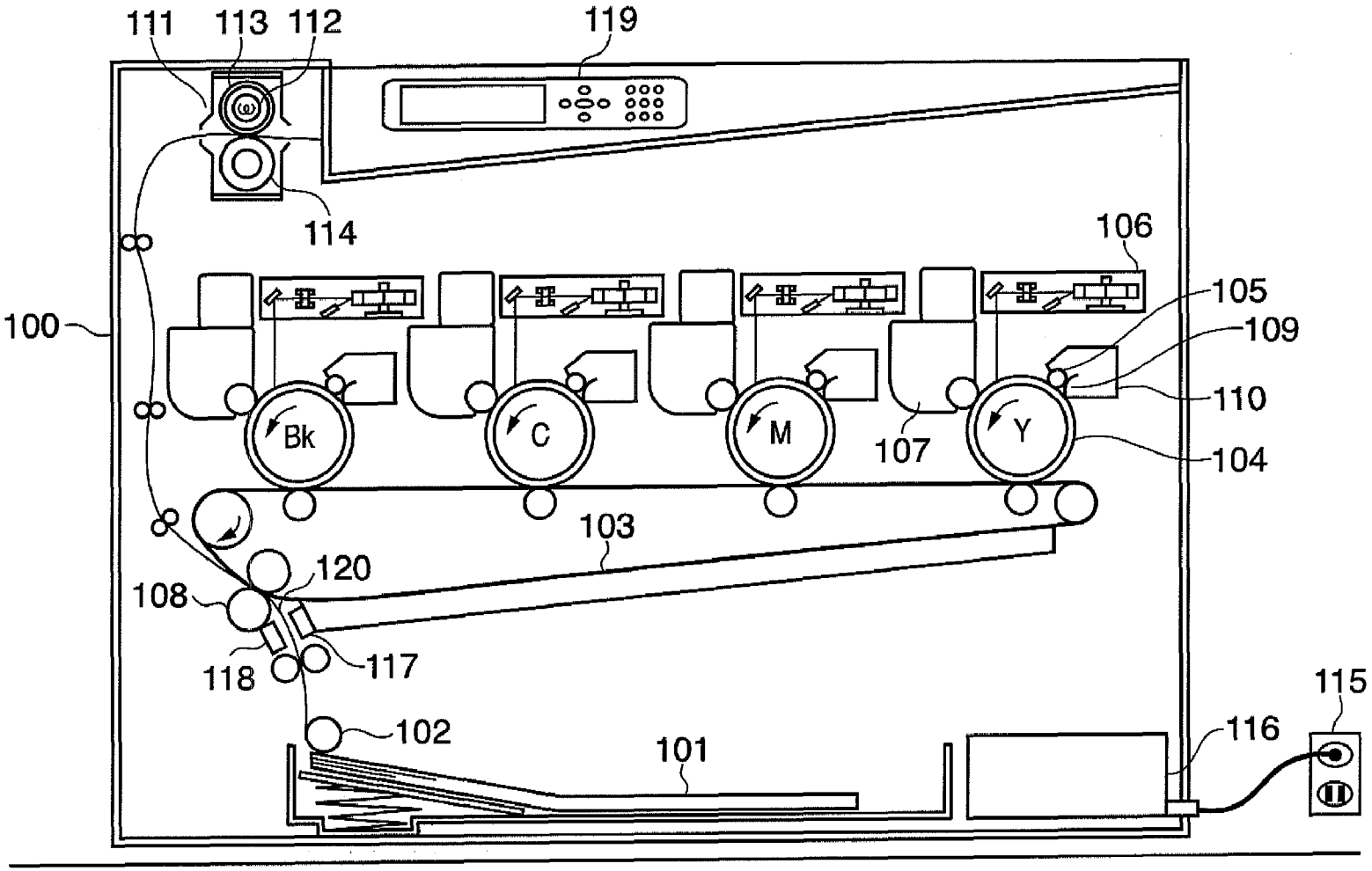
FIG. 1 is a schematic structural view illustrating an example of an image forming apparatus according to an embodiment of the present invention.

FIG. 1 is a schematic structural view illustrating an example of an image forming apparatus according to an embodiment. This image forming apparatus is a color laser printer that employs an intermediate transfer member. It should be noted that the color laser printer of the kind shown in FIG. 1 is also referred to as a tandem printer. Furthermore, the image forming apparatus may be implemented in the form of, for example, a printing apparatus, printer, copier, multifunction peripheral or facsimile machine. The method of image formation may be, for example, electrophotography, electrostatic printing, ink-jet printing, sublimation printing or offset printing.

As illustrated in FIG. 1, the image forming apparatus has a main body 100 in which a printing medium 101 is fed by a feed roller 102 and conveyed toward an intermediate transfer member 103. A photosensitive drum 104 serving as an image carrier is rotationally driven in the direction of the arrow at a prescribed speed by motive power from a driving motor (not shown). In the process of being rotated, the photosensitive drum 104 is subjected to uniform charging by a primary charging unit 105.

A laser beam scanner 106 which is part of an image forming unit outputs a laser beam while controlling the amount of emitted light thereof in accordance with a video signal that has been modulated in conformity with an image signal. The photosensitive drum is irradiated by the laser beam. As a result, an electrostatic latent image is formed on the photosensitive drum 104. A developing unit 107 forms a toner image (developer image) by causing toner, which is a developer in powder form, to adhere to the electrostatic latent image. The toner image that has been formed on the photosensitive drum 104 is transferred by primary transfer to the intermediate transfer member 103, which is rotated while in contact with the photosensitive drum 104. The printing medium 101, which has been conveyed at an appropriate timing in sync with rotation of the intermediate transfer member 103, is brought into pressured contact with the intermediate transfer member 103 by a secondary transfer roller 108 to which a transfer bias has been applied. The secondary transfer roller 108 constitutes the main mechanism of a secondary transfer unit.

A waste-toner cleaning unit 109 removes toner remaining on the photosensitive drum. A waste-toner container 110 accommodates waste toner collected by the waste-toner cleaning unit 109.

The photosensitive drum 104, primary charging unit 105, laser beam scanner 106, developing unit 107, waste-toner cleaning unit 109 and waste-toner container 110 are provided in a number equivalent to the number of toner colors used. For example, if toners of the four colors black, yellow, magenta and cyan are used, then four of the above-mentioned units are provided for the four colors. In FIG. 1, reference characters Bk, Y, M and C represent photosensitive drums for the colors black, yellow, magenta and cyan, respectively. For each color, the configuration of the primary charging unit, laser beam scanner, developing unit, waste-toner cleaning unit and waste-toner container is the same. The waste-toner container is one example of a collecting unit for collecting toner.

A fixing device 111, which is one example of a fixing unit, has a fixing roller 113 incorporating a fixing heater 112, and a pressurizing roller 114 for coming into pressured contact with the fixing roller 13. The fixing device 111 subjects the printing medium 101 to heat and pressure, thereby fixing the toner image. The printing medium 101 is then ejected to the exterior of the apparatus as printed matter. The printing medium may also be referred to as a printing material, recording medium, paper, sheet, transfer member or transfer paper.

A power-source device 116 connected to a commercial power supply 115 rectifies AC to DC and supplied each of the aforementioned units with power that is consumed by the image forming process.

A printing-medium determination sensor 117 is one example of an electrical element used to determine the type of printing medium. A characterizing feature of the present invention is that the printing-medium determination sensor 117 is attached to a consumable unit which is mainly the intermediate transfer member 103. The consumable unit is a unit which includes a consumable member that deteriorates with use. The unit, which is removably installed in the main body of the image forming apparatus 100, is must be replaced during the service life of the image forming apparatus. Since the printing-medium determination sensor 117 is attached to the consumable unit, it is replaced together with the consumable unit.

With the consumable unit installed in the main body of the image forming apparatus, the printing-medium determination sensor 117 is placed in close proximity to a conveyance path 120 along which the printing medium is conveyed. In other words, the position at which the printing-medium determination sensor 117 is provided in the consumable unit is decided based upon the positional relationship between the position at which the consumable unit is secured with respect to the main body and the position of the conveyance path 120 of the printing medium.

An LED 118 for light transmission is used in order to measure the thickness or grammage of the printing medium. That is, the LED 118 is provided on the side opposing the electrical parts (e.g., the printing-medium determination sensor 117) with the printing medium and a diffusing plate (described later) interposed therebetween. The LED 118 is one example of light-emitting unit used in order to sense the thickness or grammage of the printing medium. The printing-medium-permeating light LED 118 also may be considered to be part of the printing-medium determination sensor 117. A control panel 119 can be operated by the user to perform various settings.

Figure 2:
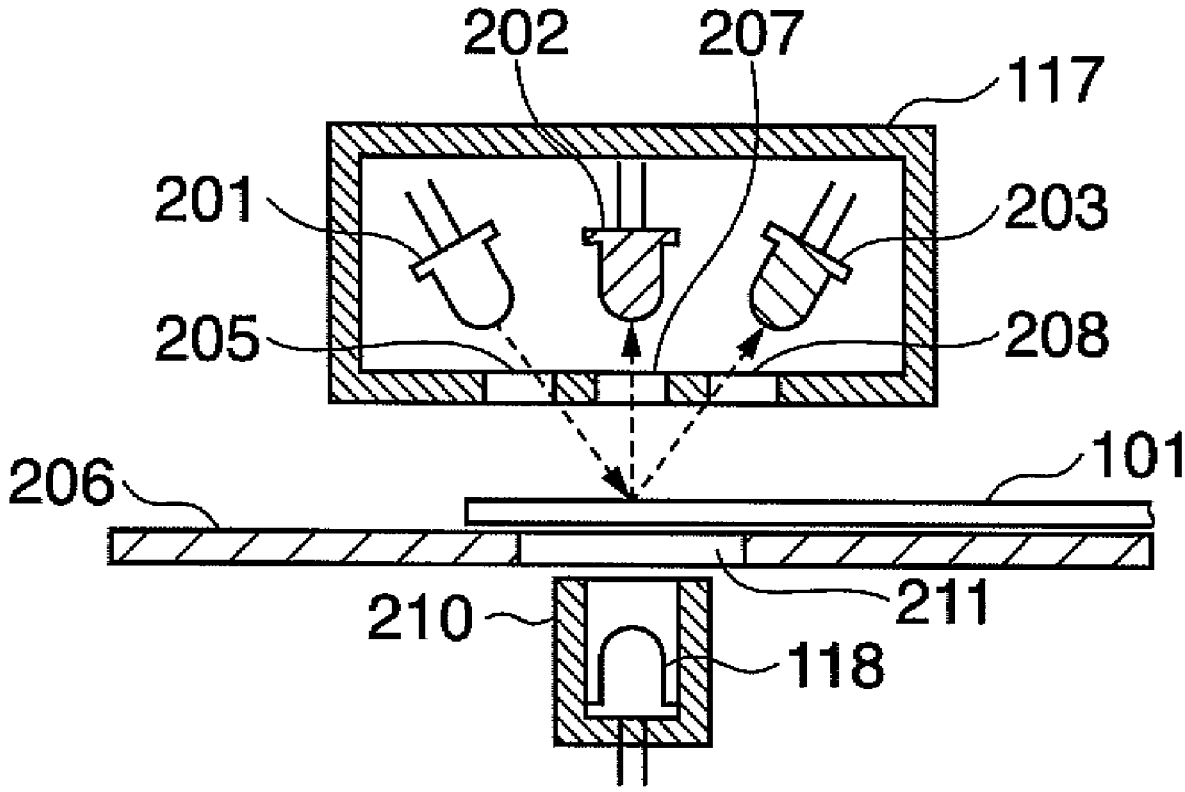
FIG. 2 is a diagram illustrating an example of a sensor for determining the type of printing medium according to the embodiment.

FIG. 2 is a diagram illustrating an example of a sensor for determining the type of printing medium according to the embodiment. As illustrated in FIG. 2, the printing-medium determination sensor 117 includes a reflected-light LED 201, which is one example of first light-emitting unit, a phototransistor 203, which is one example of a first light-receiving unit, and a phototransistor 202, which is one example of a second light-receiving unit. The arrangement may be one in which the printing-medium determination sensor 117 further includes the printing-medium-permeating light LED 118, which is one example of a second light-emitting unit. In this embodiment, the printing-medium determination sensor 117 has at least the reflected-light LED 201 and the phototransistors 202, 203. The printing-medium-permeating light LED 118 is provided on the side of the main body of the image forming apparatus. In accordance with FIG. 2, the printing-medium-permeating light LED 118 is provided on the side opposite the printing-medium determination sensor 117 with the conveyance path 120 (see FIG. 1) of the printing medium interposed therebetween. It should be noted that the reflected-light LED 201 and printing-medium-permeating light LED 118 are examples of light-emitting elements for irradiating the printing medium with light. The phototransistors 202, 203 are examples of light-receiving elements for receiving light from the printing medium.

Light from the reflected-light LED 201 irradiates the surface of the printing medium 101 on a printing-medium conveyance guide 206 via an irradiation slit 205. The printing-medium conveyance guide 206 is provided with a window for allowing irradiation with light from the back side of the printing medium 101. A diffusing plate 211 for diffusing light is provided at the window portion. The diffusing plate 211 is capable of reflecting some of the light from the reflected-light LED 201 and of transmitting some of the light from the printing-medium-permeating light LED 118. A plate made of white plastic can be used as the diffusing plate 211.

Light reflected from the printing medium 101 is collected via first and second slits 207, 208 for receiving light and is received by the phototransistors 202, 203, respectively. The glossiness of the printing medium 101 is determined by detecting the output of the phototransistor 202 indicative of the diffuse-reflection component and the output of the phototransistor 203 indicative of the specular-reflection component.

Light from the printing-medium-permeating light LED 118 irradiates the back side of the printing medium 101 through a converging guide 210 provided in order to converge the light. Light that has passed through the printing medium 101 is received by the phototransistors 202, 203 via the first and second slits 207, 208, respectively. The quantity of light that has passed through the printing medium 101 is thus detected.

In this embodiment, the reflected-light LED 201 is placed in such a manner that the light from the LED 201 irradiates the surface of the printing medium 101 at a prescribed angle (i.e., in such a manner that the printing medium is irradiated with light from an oblique direction), as illustrated in FIG. 2. Further, according to this embodiment, the printing-medium-permeating light LED 118 is placed at a position directly underlying the phototransistor 202, as shown in FIG. 2.

Figure 3:
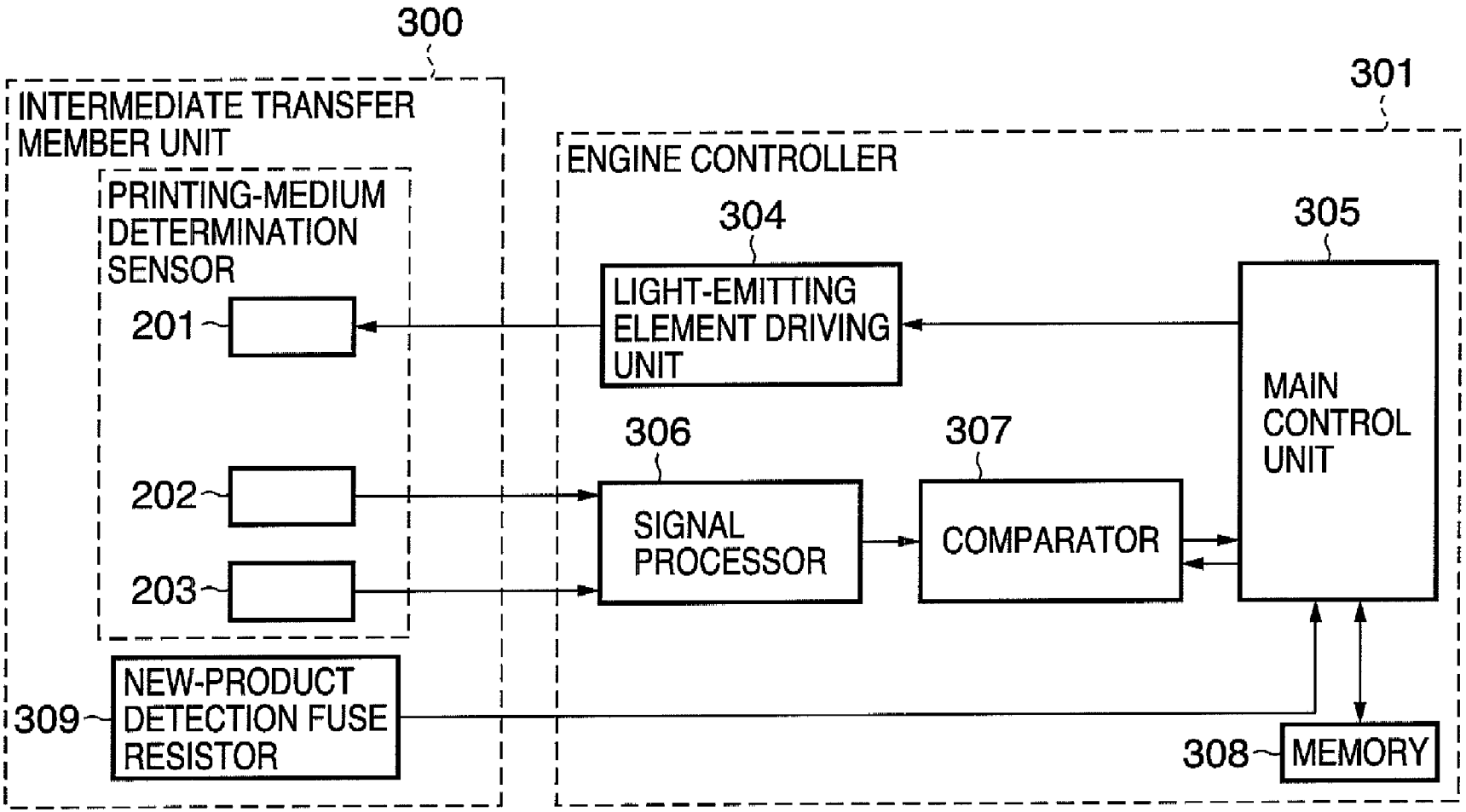
FIG. 3 is a block diagram illustrating an example of the internal configuration of a sensor controller.

FIG. 3 is a block diagram illustrating an example of the internal configuration of a sensor controller. Components already described are identified by like reference characters. An intermediate transfer member unit 300 is a consumable unit the core of which is the above-described intermediate transfer member 103. An engine controller 301 sets fixing conditions in the fixing unit in accordance with the type of printing medium sensed by the sensor.

The engine controller 301 is equipped with the following control units: a light-emitting element driving unit 304 for driving the reflected-light LED 201 and printing-medium-permeating light LED 118, and a main control unit 305 for controlling the light-emitting element driving unit 304. The main control unit 305 has, for example, a CPU, a ROM and a RAM in order to execute various control operations.

A signal processor 306 subjects the output values from the phototransistors 202, 203 to such processing as an analog-to-digital conversion at a resolution of 16 bits. For example, based on the output values, the signal processor 306 obtains a ratio value (specular-reflection output/diffuse-reflection output) indicating the glossiness of the printing medium and a ratio value (diffuse-transmission output in a state in which the printing medium is present/diffuse-transmission output in a state which the printing medium is absent) indicating the light transmittance of the printing medium. It should be noted that the diffuse-transmission output is a value that is output in response to light from the LED 118, which has passed through the diffusing plate and printing medium, being received by the phototransistor 202. Further, a comparator 307 is an arithmetic unit which, based on the result from the signal processor 306, makes a comparison with set values that have been stored beforehand in a storage element such as a memory 308.

The memory 308 is, for example, a non-volatile memory such as an EEPROM. The memory 308 stores set values used in order to determine the type of printing medium. Examples of set values stored in the memory 308 are a value LSR of light-emission quantity calculated from the specular-reflection quantity of light acquired using a reference plate (or reference paper) at the time of shipping from the factory, and a value LDR of light-emission quantity calculated from the diffuse-reflection quantity of light acquired using a reference plate (or reference paper) at the time of shipping from the factor. Based on the values of LSR and LDR, the light-emitting element driving unit 304 adjusts the voltage that drives the LED 201 serving as the light-emitting unit, thereby adjusting the quantity of emitted light. In other words, when the photosensitivity of the phototransistors 202, 203 varies, LSR and LDR are used in order to adjust for a variation in quantity of light emitted by the LED 201 serving as the light-emitting unit.

The intermediate transfer member unit 300 has, in addition to the printing-medium determination sensor comprising the light-emitting and light-receiving elements, a fuse resistor 309 for sensing a new intermediate transfer member unit. The main control unit 305 decides that a new intermediate transfer member unit 300 has been installed in the main body unless the fuse resistor 309 has blown. If the fuse resistor 309 has blown, on the other hand, then the main control unit 305 decides that the intermediate transfer member unit 300 is a unit that has once been installed in the image forming apparatus and has started to be used (i.e., that the unit is a used unit). It should be noted that if the fuse resistor 309 has not been has blown, then a fuse-resistor blow circuit (not shown) provided in the engine controller 301 blows the fuse resistor 309. As a result, the intermediate transfer member unit 300 changes from a state in which it is new to a state in which use has started.

Figure 4:
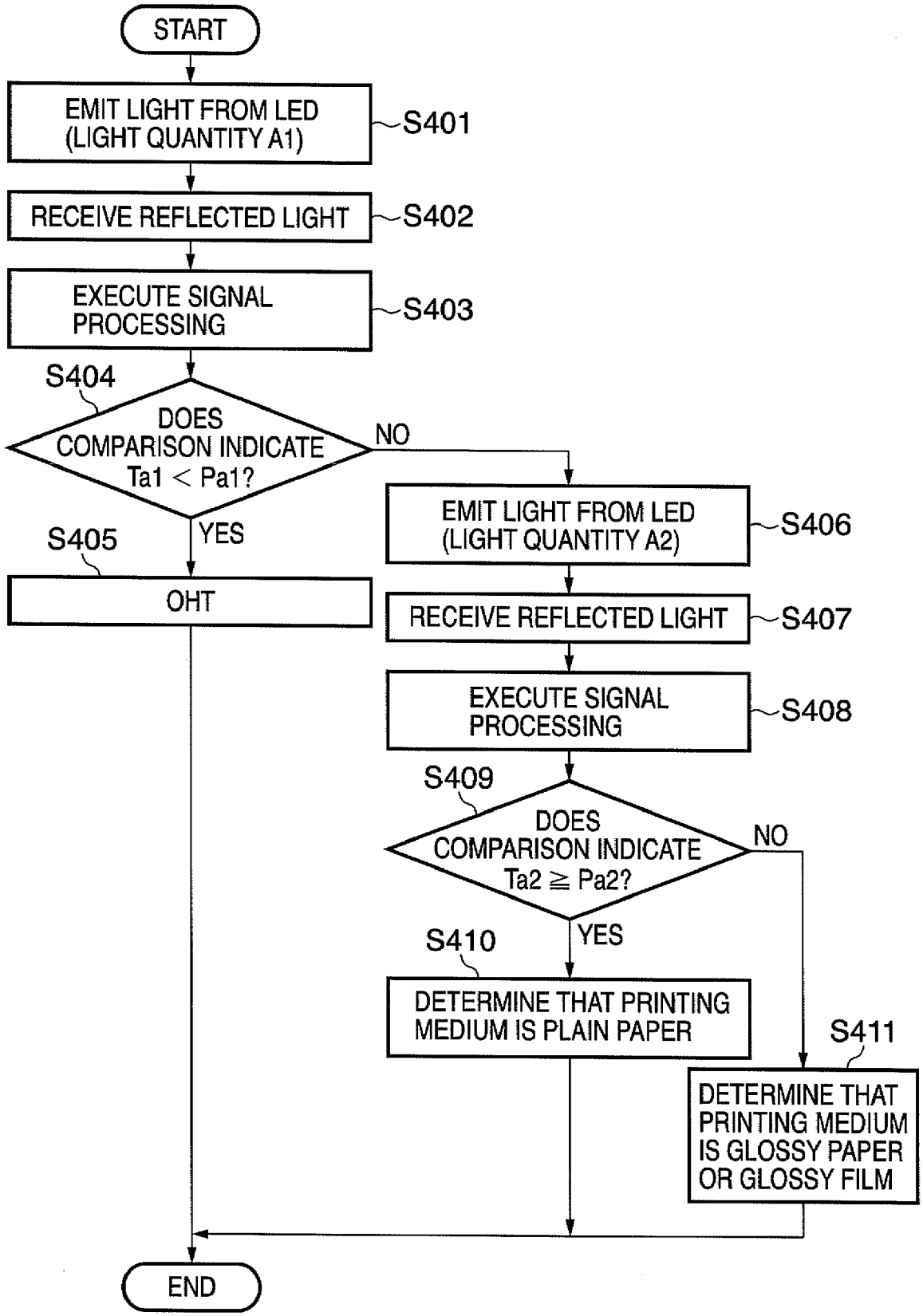
FIG. 4 is a flowchart illustrating an example of a method of determining the type of printing medium according to the embodiment.

FIG. 4 is a flowchart illustrating an example of a method of determining the type of printing medium according to the embodiment. Here it is determined whether the type of printing medium is any of OHT, plain paper, glossy paper or glossy film, depending upon the ratio value [spectral-reflection output (quantity of light)/diffuse-reflection output (quantity of light)] indicative of glossiness acquired by the printing-medium determination sensor 117. These types of printing media are merely illustrative. In this embodiment, it is assumed that the quantity of light emitted by the reflected-light LED 201 is switched between two stages.

In step S401, the light-emitting element driving unit 304 causes the reflected-light LED 201 to emit light of light quantity A1. The printing-medium-permeating light LED 118 is in an extinguished state at this time. In step S402, the phototransistor 203 receives specular-reflection light and the phototransistor 202 receives diffuse-reflection light. In step S403, the signal processor 306 applies the output values from the phototransistors to signal processing and calculates a ratio value Pa1 [spectral-reflection output (quantity of light)/diffuse-reflection output (quantity of light)] indicating the glossiness of the printing medium.

In step S404, the comparator 307 acquires a threshold value Ta1, which is for determining glossiness and has been stored beforehand in the memory 308, through the main control unit 305 and compares Ta1 with the value Pa1 indicative of glossiness. If Ta1<Pa1 holds, control proceeds to step S405, where the main control unit 305 determines that the type of printing medium is OHT and sets image forming conditions for OHT.

If Ta1>Pa1 holds, on the other hand, control proceeds to step S406 and the main control unit 305 instructs the light-emitting element driving unit 304 in such a manner that the reflected-light LED 201 emits light of light quantity A2 (>A1). In response to being so instructed, the light-emitting element driving unit 304 drives the reflected-light LED 201 so as to emit light of light quantity A2.

In step S407, the phototransistor 203 receives spectral-reflection light and the phototransistor 202 receives diffuse-reflection light. In step S408, the signal processor 306 subjects the output values from the phototransistors to signal processing and calculates a ratio value Pa2 (spectral-reflection light quantity/diffuse-reflection light quantity) indicating the glossiness of the printing medium.

In step S409, the comparator 307 compares a threshold value Ta2, which is for determining glossiness and has been read out of the memory 308 as a set value, with the value Pa2 indicative of glossiness. If Ta2≧Pa2 holds, control proceeds to step S410, where the main control unit 305 determines that the type of printing medium is plain paper and sets image forming conditions for plain paper.

If Ta2≧Pa2 does not hold, on the other hand, control proceeds to step S411. Here the main control unit 305 determines that the type of printing medium is glossy paper or glossy film and sets the image forming conditions.

The reason for setting the two threshold values Ta1 and Ta2 is that first whether or not the printing medium is OHT is determined based upon Ta1 and then whether or not plain paper is glossy paper or glossy film is determined using Ta2.

Described next will be a method of correcting (calibrating) a deterioration in the output of the printing-medium determination sensor due to contamination with paper dust or toner. The reason why the output of the printing-medium determination sensor deteriorates owing to paper dust or toner is that the paper dust or toner penetrates into the interior of the sensor from the slits 205, 207, 208 in FIG. 2 and diminishes the intensity of light received and light emitted.

First, when the intermediate transfer member unit is new, the specular-reflection light component of the light emitted from the LED toward the corrective member (e.g., a reference plate, etc.) is received by the phototransistor 203, and the diffuse-reflection light component is received by the phototransistor 202. Let CIA and CIB represent the value of the output received by the phototransistor 203 and the value of the output received by the phototransistor 202, respectively.

In a case where the intermediate transfer member unit has been incorporated in the main body of the apparatus at the time the apparatus is shipped from the factory, this operation is performed at the time of shipping.

The output value CIA of the specular-reflection light quantity and the output value CIB of the diffuse-reflection light quantity are stored beforehand in the memory 308 as respective initial output values. Since it will suffice if this process is executed in a state in which the LEDs or phototransistors are not contaminated with paper dust or toner (or a state in which the image forming apparatus is in the initial stage of use), the user may execute the process when the image forming apparatus is used the first time. In a case where the image forming apparatus is used the first time, the output values of the specular-reflection light quantity and diffuse-reflection light quantity can be obtained by irradiating the diffusing plate 211 with light, by way of example.

One example will be described here. Before the printing medium is fed up to the printing-medium determination sensor 117 following acceptance of a print job by the image forming apparatus, the main control unit 305 causes each of the LEDs to emit light so that the light reflected from the diffusing plate 211 serving as the corrective member is received by the phototransistors 203, 202. It should be noted that in a case where a diffusing plate is not provided, it will suffice if a diffusing plate or reference plate serving as the corrective member is placed temporarily at a position where it will block the hole provided in the printing-medium conveyance guide 206.

Let CPA and CPB represent an output value of specular-reflection light and an output value of diffuse-reflection light, respectively, received from the diffusing plate serving as the corrective member. The values of CPA and CPB, which are the present output values from the diffusing plate, are stored in the memory 308 temporarily. The main control unit 305 obtains correction coefficients a, b from the value of the initially stored CIA and CIB and the values of CPA and CPB measured at the start of printing.

It should be noted that measurement of CPA and CPB may be performed every time printing is performed at the timing at which printing starts, or may be performed whenever a prescribed number of sheets is printed (e.g., whenever 100 sheets are printed) rather than every time. The coefficients a and b are as indicated by the following equations:

$$a=CPA/CIA \quad (a<0)$$

$$b=CPB/CIB \quad (b<0)$$

Next, when the printing medium passes by the printing-medium determination sensor 117 at the time of printing, the main control unit 305 causes the reflected-light LED 201 to emit light. The specular-reflection light from the printing medium is received by the phototransistor 203 and the diffuse-reflection light is received by the phototransistor 202. Let PSA, PSB respectively represent the output values prevailing at this time. The signal processor 306 reads the correction coefficients a and b out of the memory 308 and corrects the output values PSA and PSB by the correction coefficients as indicated below to thereby obtain PCA and PCB.

$$PCA=PSA/a$$

$$PCB=PSB/b$$

The output values of the printing-medium determination sensor 117 are thus obtained. However, even if such a correction is applied, it is conceivable that the quantity of light will decline by a large margin owing to the adhesion of paper dust or toner to the surfaces of the light-emitting and light-receiving elements in a case where the image forming apparatus has been used for a prolonged period of time or in a case where a large amount of printing formation has been carried out. In other words, a case where the accuracy with which the type of printing medium is determined cannot be maintained even if the above-described correction is performed is conceivable.

Figure 5:
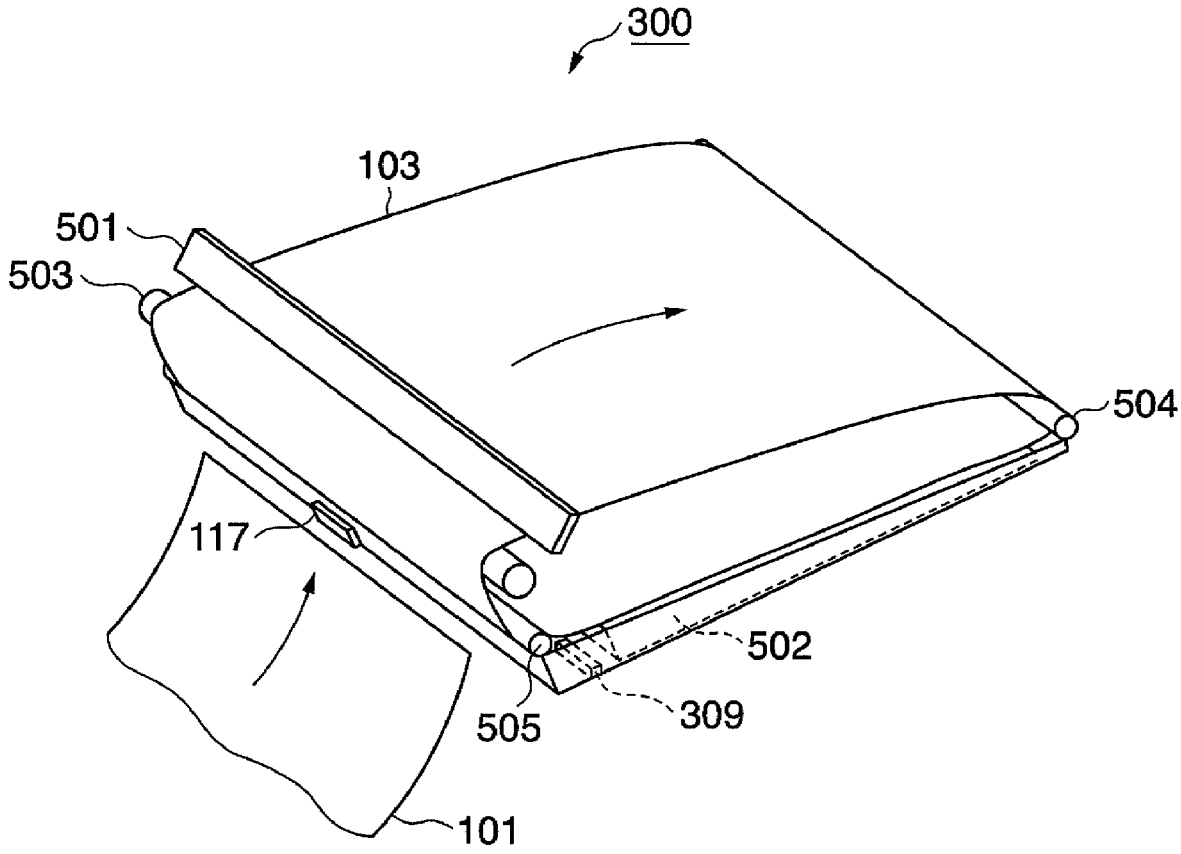
FIG. 5 is a perspective view illustrating an example of an intermediate transfer member unit.

FIG. 5 is a perspective view illustrating an example of an intermediate transfer member unit. The intermediate transfer member unit includes the intermediate transfer member 103, such as an intermediate transfer belt, a residual-toner cleaner 501, a residual-toner box 502, a belt driving roller 503, a follower roller 504 and a secondary transfer roller 505. The secondary transfer roller 505 forms a pair with the secondary transfer roller 108.

The intermediate transfer member 103 is stretched among and revolves around the belt driving roller 503, follower roller 504 and secondary transfer roller 505 and is driven in the direction of the arrow. A toner image that has been transferred from the photosensitive drum 104 to the intermediate transfer member 103 by primary transfer is transferred by the secondary transfer roller 505 to the printing medium 101 by secondary transfer. The secondary transfer roller 505 forms a pair with the secondary transfer rollers 108 mentioned above. The residual-toner cleaner 501, which is for scraping off residual toner remaining on the intermediate transfer member 103, is provided at the periphery of the intermediate transfer member 103 between the secondary transfer roller 505 and the primary transfer unit located downstream of the roller 505. The residual toner scraped off by the residual-toner cleaner 501 is collected in the residual-toner box 502. The toner recovery mechanism from the residual-toner cleaner 501 to the residual-toner box 502 is a well-known arrangement and need not be described here.

The intermediate transfer member 103 is a consumable member. The belt surface deteriorates with lone-term use and there are instances where the formed toner image becomes defective. Further, in a case where the image forming apparatus has been used over a prolonged period of time or a large amount of image formation has been performed, there are instances where the residual-toner box 502 becomes filled with collected residual toner. This makes it necessary to replace the intermediate transfer member unit 300.

As illustrated in FIG. 5, the printing-medium determination sensor 117 is provided on the intermediate transfer member unit 300. Since the intermediate transfer member unit 300, which is a consumable, is replaced by a new unit, this is attended by replacement of the printing-medium determination sensor 117 as well. In other words, the printing-medium determination sensor 117 for which there is the possibility of a decline in determination accuracy owing to paper dust or toner is replaced by a new one. As a result, this suppresses the occurrence of cases where, even though a correction is applied, the printing-medium determination accuracy cannot be maintained owing to a major decline in the quantity of light due to adhesion of paper dust or toner to the surface of the light-emitting and light-receiving elements. That is, it is possible for the determination accuracy of the printing-medium determination sensor 117 to be maintained satisfactorily from start of use to end of product lifetime.

Further, as mentioned above, the printing-medium determination sensor 117 is placed at a position in close proximity to the conveyance path 120 of the image forming apparatus in a state in which the intermediate transfer member unit 300, which is a consumable, has been installed in the main body of the apparatus. In this example, the configuration is such that the distance from the printing-medium determination sensor 117 to the printing medium conveyed along the conveyance path 120 is about 5 mm. This distance should be decided appropriately depending upon sensor sensitivity and performance.

It should be noted that when the intermediate transfer member unit 300 is replaced, the main control unit 305 senses whether or not the unit is new by the fuse resistor 309, which is for sensing a new unit, provided on the intermediate transfer member unit 300. If a new intermediate transfer member unit 300 is sensed or the fact that it is new is set using the control panel 119, the main control unit 305 acquires the values of the initial output values CIA and CIB again and stores them in the memory 308 again.

In accordance with this embodiment, an electrical element used to determine the type of printing medium is provided on a consumable unit that requires replacement at a cycle shorter than the product lifetime of the main body of the image forming apparatus. The electrical element is attached to the consumable unit and is replaced together with the consumable unit. As a result, even if the image forming apparatus is one that has a long lifetime, the printing-medium determination accuracy can be maintained from start of use to end of product lifetime.

In particular, in a case where the electrical element or electronic element is constituted by a light-emitting element or light-receiving element, the element is readily susceptible to the influence of paper dust or toner. This embodiment, therefore, is particularly effective in such case.

Second Embodiment

In this embodiment, portions similar to portions in the first embodiment are not described again and the focus of the description will be the portions that are different. This embodiment will be described with regard to an arrangement in which a storage element storing information used in order to determine the type of printing medium also is provided on a consumable unit.

Figure 6:
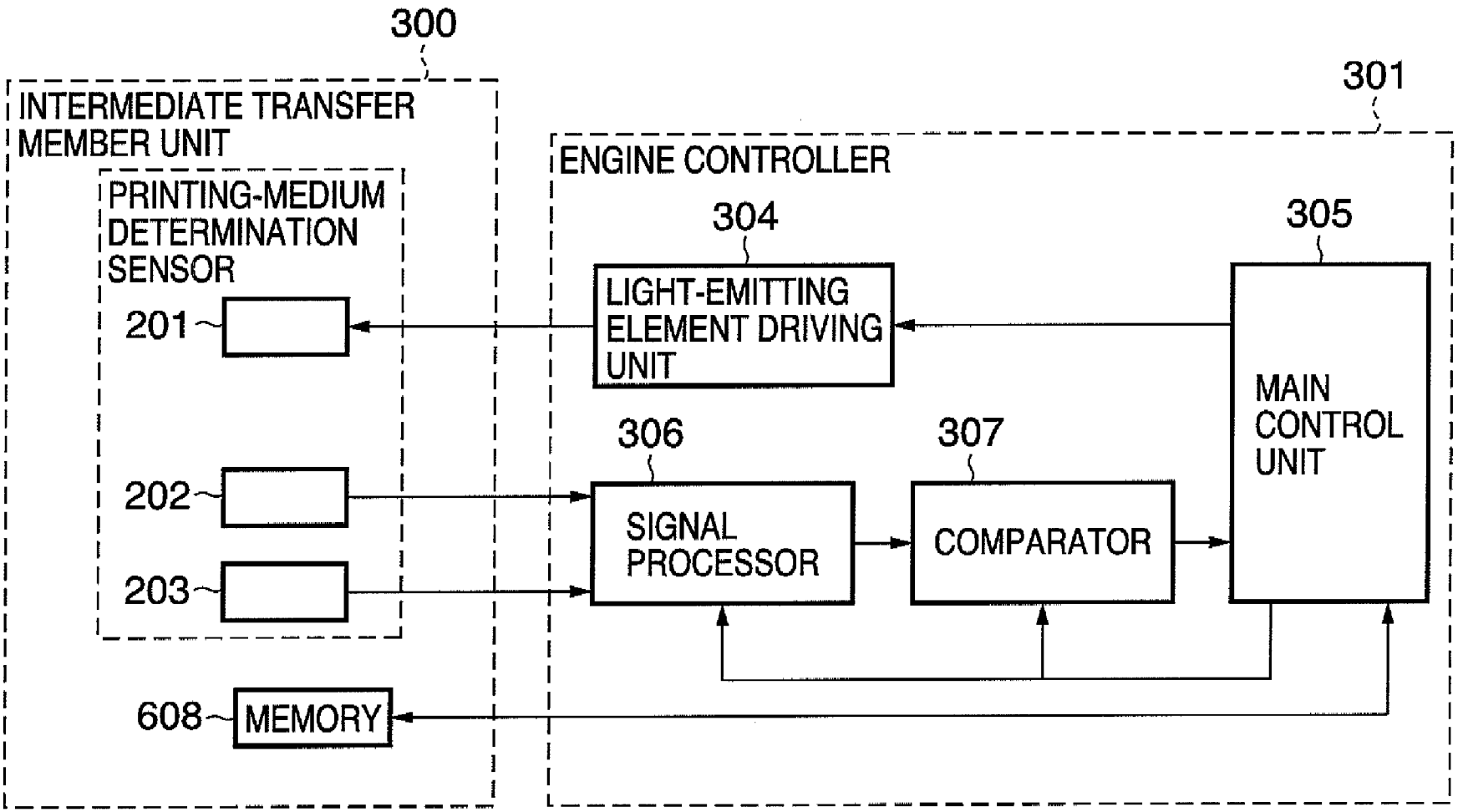
FIG. 6 is a block diagram illustrating an example of the internal configuration of a sensor controller.

FIG. 6 is a block diagram illustrating an example of the internal configuration of a sensor controller. Components already described are identified by like reference characters. In comparison with FIG. 3, a memory 608 is employed instead of the memory 308, which is one example of a storage unit. Moreover, the memory 608 is mounted on the intermediate transfer member unit 300. The memory 608 is capable of being implemented by a non-volatile memory such as an EEPROM. As in the manner of the memory 308, the memory 608 stores set values used in order to correct outputs from the printing-medium determination sensor. As mentioned above, the set values are the values LSR, LDR of light-emission quantity acquired as at the time of shipping, the initial output values CIA, CIB and the threshold values Ta1, Ta2 for discriminating glossiness.

In general, there is some variation in the mounting position of the reflected-light LED 201 used by the printing-medium determination sensor 117. Further, there is also a variation in the mounting position of the printing-medium determination sensor 117 on the intermediate transfer member unit 300. If such a variation exists, then the values Pa1, Pa2 indicative of glossiness also will vary from one intermediate transfer member unit to the next. Therefore, if the threshold values Ta1, Ta2 for determining glossiness in order to determine the type of printing medium are fixed values irrespective of individual differences, then there is the danger that the printing-medium determination accuracy will decline, depending upon the unit exhibiting a large variation.

Accordingly, at the time of shipping, the set threshold values Ta1, Ta2 for determining glossiness are adjusted in conformity with the variance of every intermediate transfer member unit and the adjusted values are stored beforehand in the non-volatile memory 608 with which the intermediate transfer member unit 300 is equipped. As a result, the accuracy with which the type of printing medium is determined can be improved.

It should be noted that with regard to the correction coefficients a, b, as well, if these are stored in the memory 608 in advance, then deterioration in the outputs of the printing-medium determination sensor can be corrected accurately even when the intermediate transfer member unit 300 is replaced. As a result, the accuracy of printing-medium determination can be well maintained.

FIG. 7 is a diagram illustrating an example of a memory map of the memory 608 with which the intermediate transfer member unit is equipped. The values LSR, LDR of light-emission quantity, the initial output values CIA, CIB and the threshold values Ta1, Ta2 for determining glossiness, etc., have been stored in the memory 608. These values are read out of the memory 608 instead of the memory 308 by the main control unit 305 and are used in determining the type of printing medium. The specific methods of adjustment and determination are as described in the first embodiment.

In accordance with the second embodiment, the printing-medium determination accuracy can be maintained just as in the first embodiment by providing the consumable unit with a storage element in which information used to determine the type of printing medium has been stored. In particular, individual-difference information, such as the values LSR, LDR of light-emission quantity, the initial output values CIA, CIB and the threshold values Ta1, Ta2 for determining glossiness, etc., is stored in the memory 608 in advance, whereby variation that depends upon individual differences from one printing-medium determination sensor to the next is taken into consideration when determining the type of printing medium. Accordingly, the second embodiment has the potential to improve printing-medium determination accuracy more than the first embodiment.

The second embodiment illustrates an example in which the intermediate transfer member unit is equipped with the memory 608. As a matter of course, however, the memory may be provided on another consumable unit that is replaced at a cycle shorter than the product lifetime of the main body. Further, the memory 608 need not be an EEPROM; it will suffice if the memory is a storage element, such as a flash memory, that is capable of writing and erasing content electrically.

Third Embodiment

A third embodiment is a modification of the second embodiment. Specifically, a variable resistor that functions as a storage element is employed instead of the memory 608. That is, a characterizing feature of this modification is information used in order to determine the type of printing medium is expressed by the resistance value of the variable resistor. Portions similar to portions in the foregoing embodiment are not described again and the focus of the description will be the portions that are different.

Figure 8:
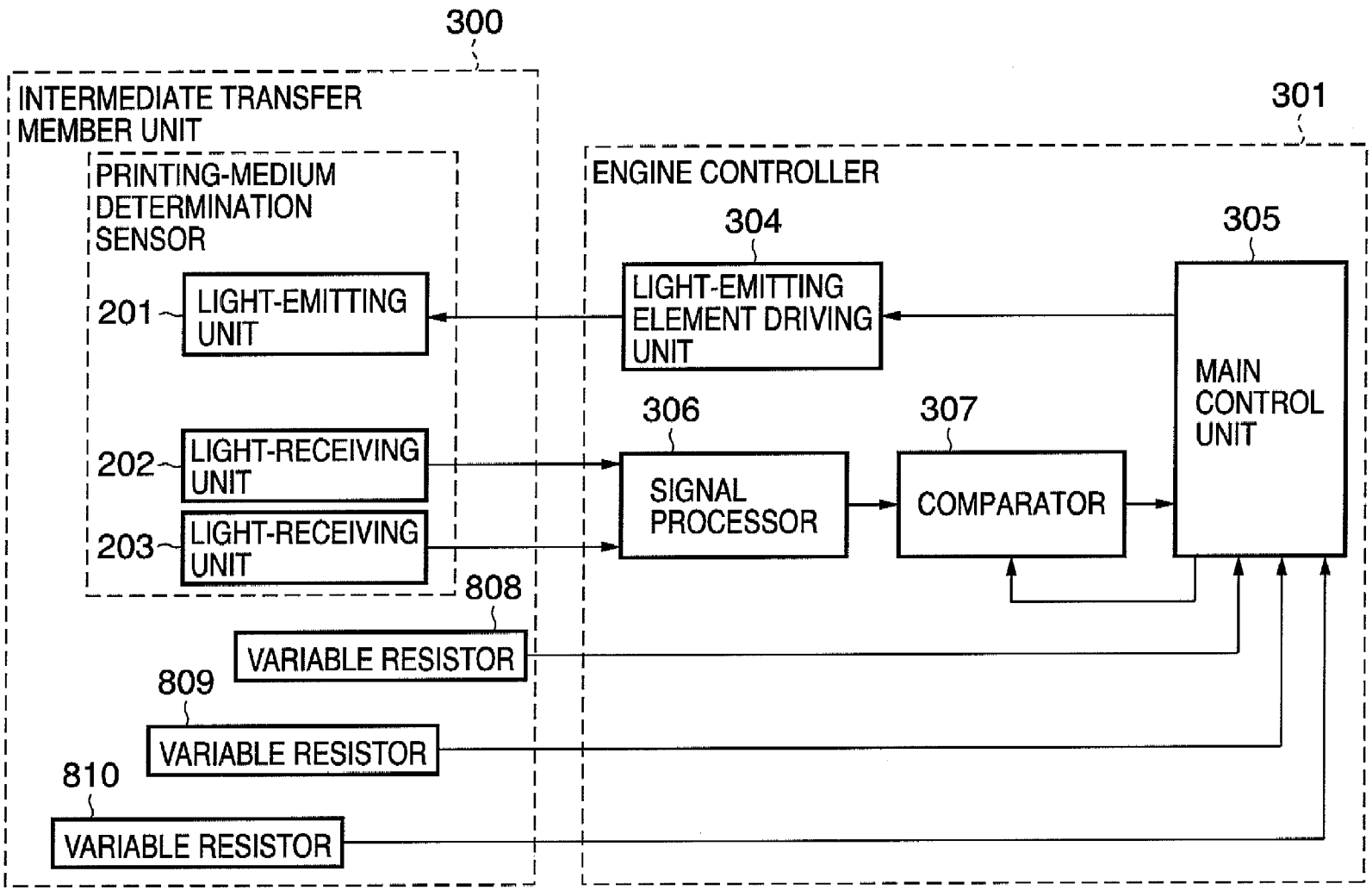
FIG. 8 is a block diagram illustrating an example of the internal configuration of a sensor controller.

FIG. 8 is a block diagram illustrating an example of the internal configuration of a sensor controller. Components already described are identified by like reference characters. In comparison with FIG. 6, three variable resistors 808, 809 and 810 are employed instead of the memory 608.

Various information acquired at the time of shipping from the factory (values stored in the memory 308 or 608 described in the first and second embodiments) is held in these variable resistors as resistance values. For example, the main control unit 305 reads the resistance values (actually voltage values) upon subjecting them to an analog-to-digital conversion and then delivers (outputs) the read values to the comparator 307, signal processor 306 or light-emitting element driving unit 304, etc.

In this embodiment, an arrangement in which threshold values for determining the type of printing medium are capable of being set by a variable resistor will be described.

More specifically, it is possible to set four patterns by varying the resistance value of one variable resistor 808. Set values (threshold values) of four patterns set using a variable resistor will be described with reference to FIGS. 10 and 11.

Figure 10:
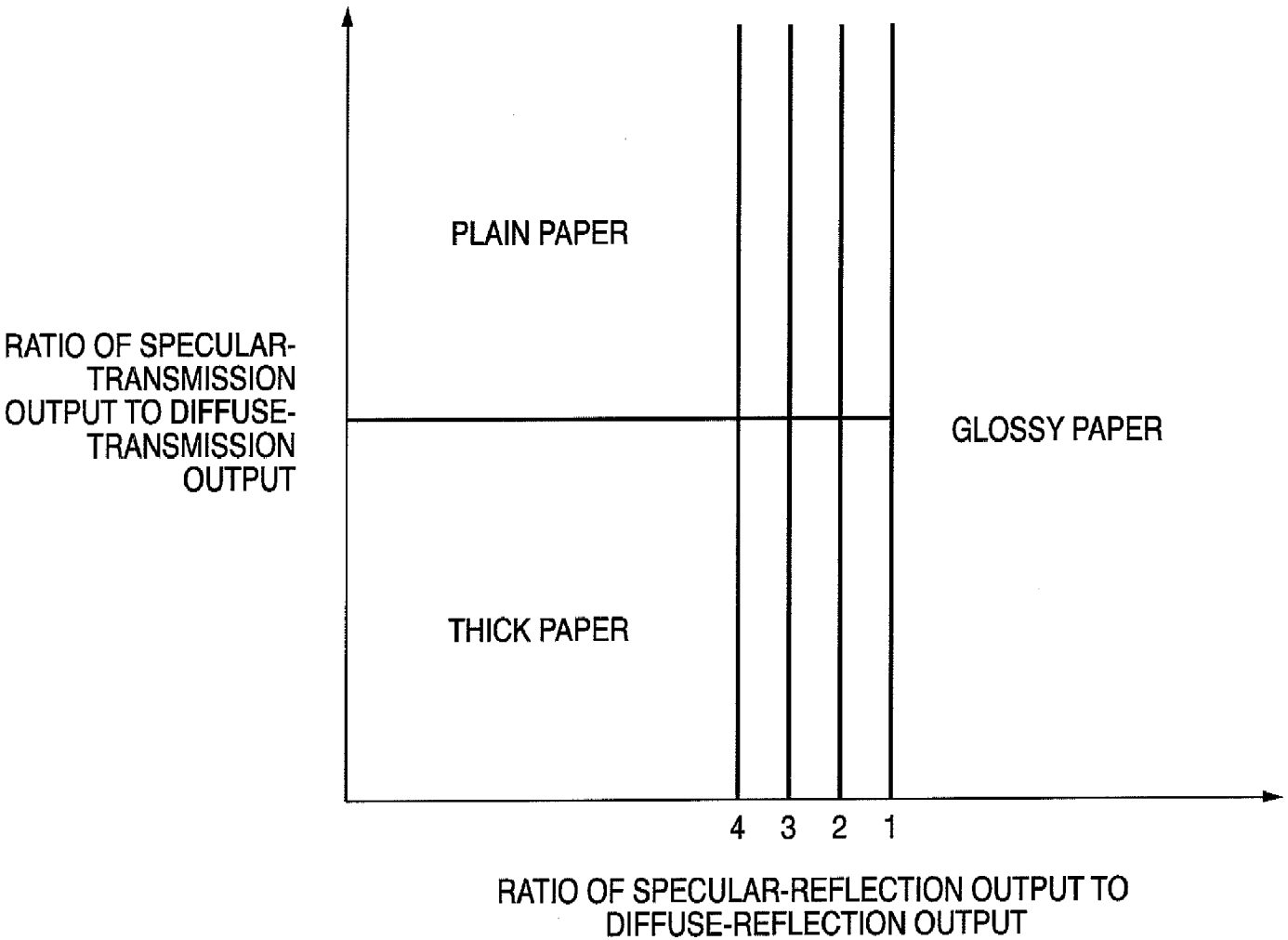
FIG. 10 is a diagram illustrating threshold values for determining types of printing media according to an embodiment.

FIG. 10 illustrates threshold values (Ta2 in the first and second embodiments) for discriminating plain paper, thick paper and glossy paper (glossy film) Each threshold value is set as a ratio, which is indicative of glossiness, between a specular-reflection output and a diffuse-reflection output. In this embodiment, the resistance value of a rotary resistor is set to values of 0 V to 1.5 V.

FIG. 11 illustrates an example in which set values (threshold values 1, 2, 3, and 4 in FIG. 10) of four patterns are set depending upon the resistance values of the variable resistor 808 (i.e., by setting the resistance values of one variable resistor). The resistance values are set to 0 V to 1.5 V, thereby setting four set values (threshold values) comprising a combination of a value indicating glossiness and a value indicating transmittance of light. The set values are set values that conform to a variation in the photosensitivities of the phototransistors 202, 203 serving as light-receiving units. The resistance value of one variable resistor is adjusted as at the time of shipping and is set to an appropriate value of from 0 V to 1.5 V.

It should be noted that the variable resistor 809 in FIG. 8 is for setting a threshold value for determining whether the printing medium is OHT (this value corresponds to Ta1 in the first and second embodiments).

Further, the variable resistor 810 in FIG. 8 is for setting the quantity of light emitted by the LED 201 serving as the light-emitting unit (this value corresponds to the value LSR or LDR of light-emission quantity in the first and second embodiments).

Figure 9:
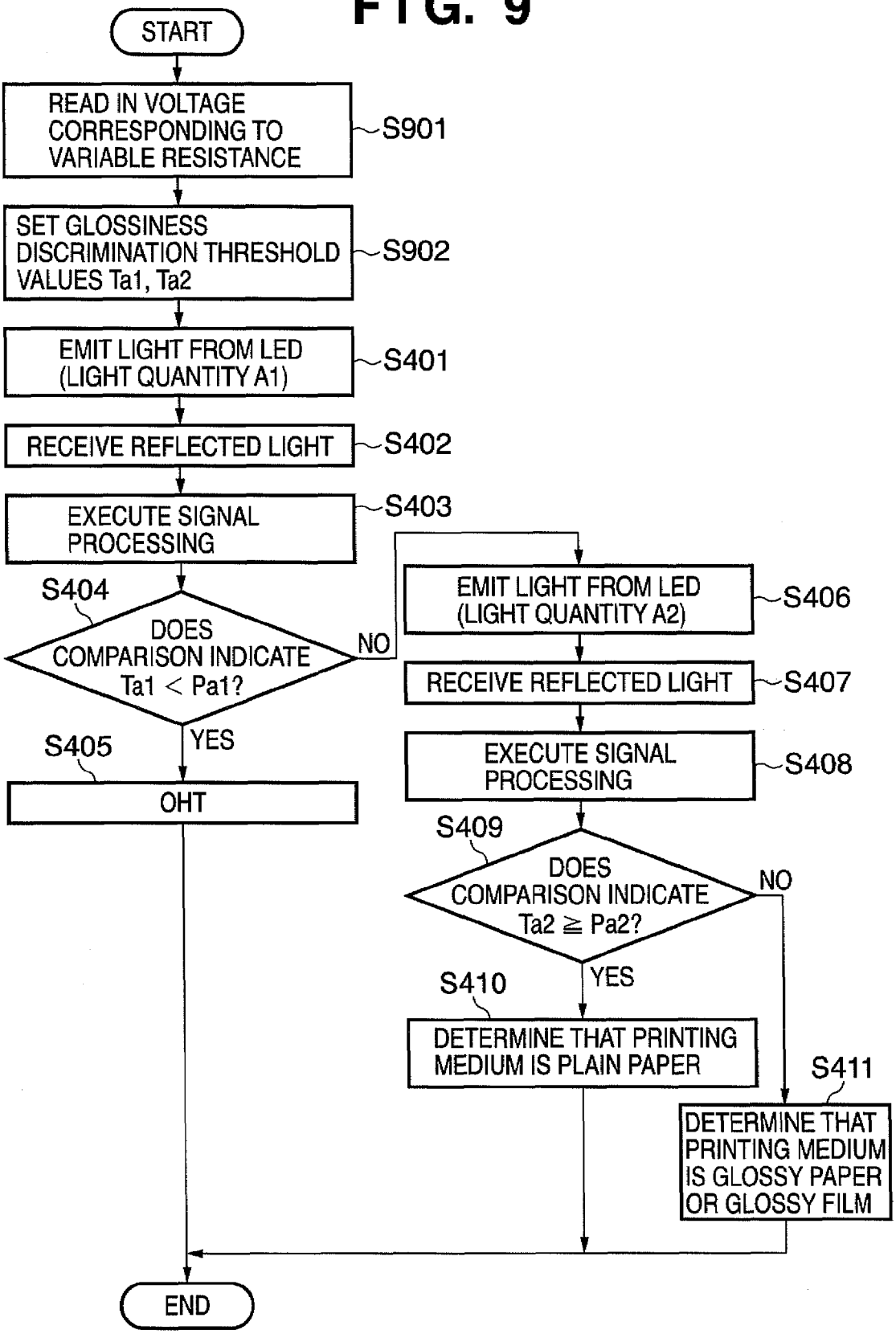
FIG. 9 is a flowchart illustrating an example of a method of determining the type of printing medium according to the embodiment.

FIG. 9 is a flowchart illustrating an example of a method of determining the type of printing medium according to the embodiment. Steps already described are identified by like step numbers and need not be described again in detail.

In step S901, the main control unit 305 applies an analog-to-digital conversion to a voltage value, which corresponds to a resistance value, from the variable resistor in which the threshold value for glossiness determination has been set, and then reads in the digital value. In step S902, the main control unit 305 refers to a table that has been stored in a non-volatile memory (not shown), decides the glossiness determination threshold values Ta1, Ta2 corresponding the voltage value read in and sets these in the comparator.

It should be noted that the threshold values 1 to 4 illustrated in FIG. 11 indicate the threshold value Ta2. The threshold value Ta1 also is set in conformity with the resistance value of the variable resistor in the same manner as the threshold value Ta2.

The steps that follow S902 are as described in the first embodiment. It should be noted that the values LSR, LDR of light-emission quantity and the initial output values CIA, CIB can be set similarly by providing corresponding variable resistors. Further, voltage values that have been read from the variable resistors may also be decided by the main control unit 305 by referring to tables. Further, the correction coefficients a, b may also be stored beforehand in corresponding variable resistors as resistance values.

Thus, a storage element may be implemented by a variable resistor and not just a memory. Effects similar to those of the second embodiment are obtained in the third embodiment as well.

Although an example in which three variable resistors are used is described in this embodiment, the number of variable resistors can be made to be a number other than three depending on the number of parameters set.

Thus, in accordance with the third embodiment, a set value is stored beforehand using a variable resistor instead of a storage element such as an EEPROM, and the printing-medium determination accuracy can be maintained as in the first and second embodiments through a simple arrangement.

Fourth Embodiment

A fourth embodiment is a modification of the third embodiment. Here also a variable resistor that functions as a storage element is employed in a manner similar to that of the third embodiment. A further advantage of this embodiment is that the sensitivity of the light-receiving unit of the printing-medium determination sensor is made adjustable using a variable resistor. Portions similar to portions in the foregoing embodiments are not described again and the focus of the description will be the portions that are different.

Figure 12:
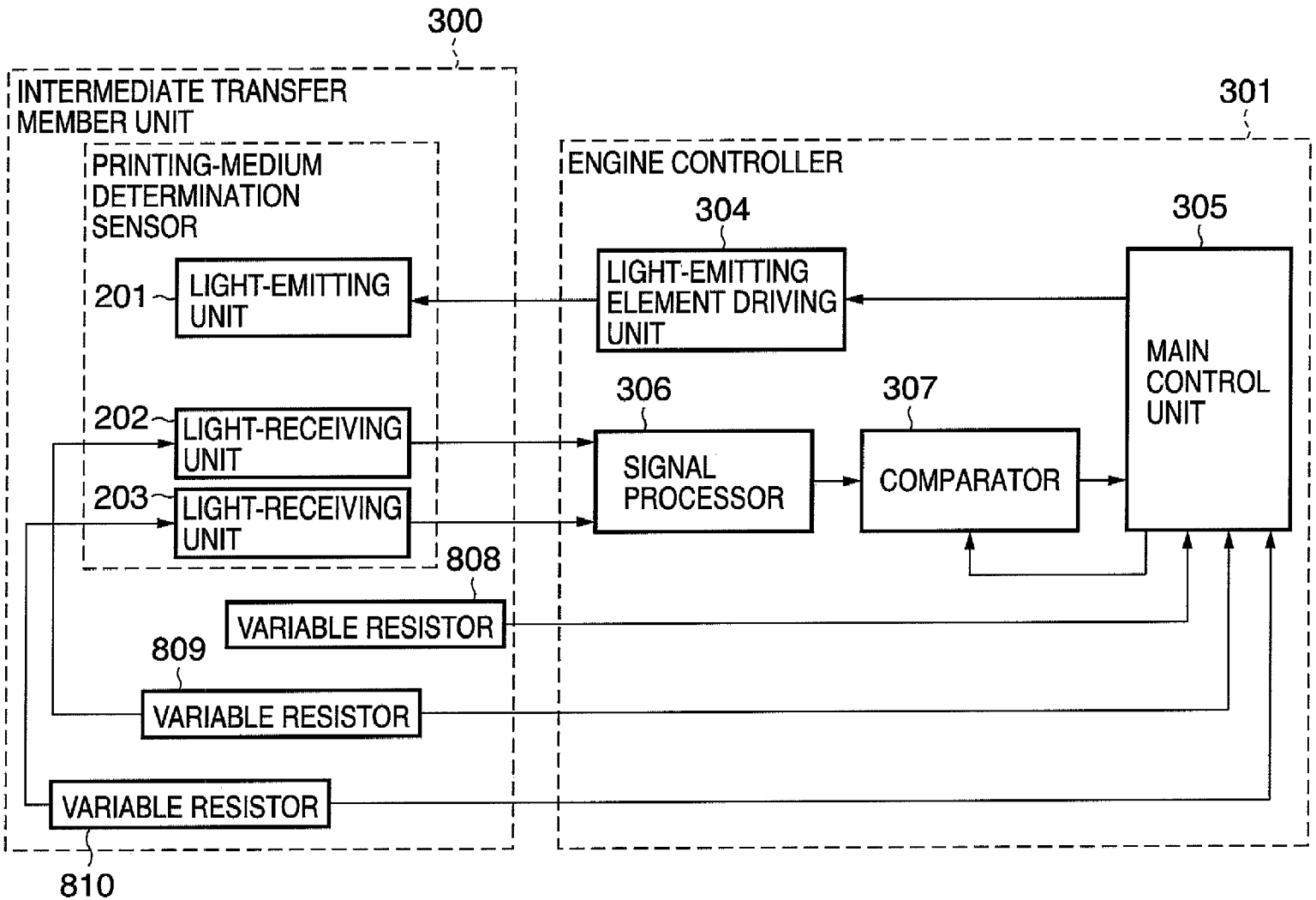
FIG. 12 is a block diagram illustrating an example of the internal configuration of a sensor controller.

FIG. 12 is a block diagram illustrating an example of the internal configuration of a sensor controller. Components already described are identified by like reference characters. In comparison with FIG. 8, this embodiment differs in that although the three variable resistors 808, 809 and 810 are employed, the sensitivity of the light-receiving unit is adjusted based upon the resistance values of the two variable resistors 809 and 810.

In FIG. 12, the photosensitivity of the light-receiving unit (phototransistor 202) is set by the resistance value of the variable resistor 809, and the photosensitivity of the light-receiving unit (phototransistor 203) is set by the resistance value of the variable resistor 810. It should be noted that the setting of photosensitivity entails setting resistance values in such a manner that values of quantity of light greater than a prescribed quantity of light can be received (output) by the phototransistors 202 and 203 of the light-receiving unit in a case where a certain fixed quantity of light has been emitted by the LED 201 (or LED 118) serving as the light-emitting unit.

Figure 13:
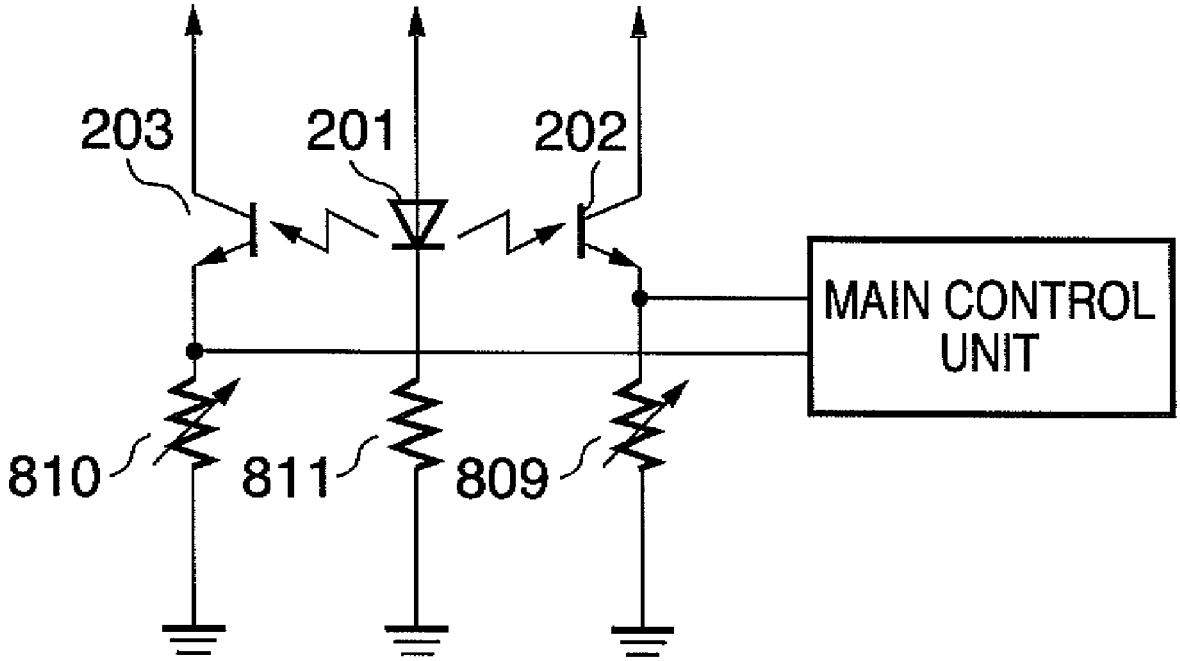
FIG. 13 is a circuit diagram of a circuit for sensitivity adjustment of a light-receiving unit in a sensor for determining a printing medium.

FIG. 13 is a circuit diagram of a circuit for adjusting the photosensitivities of the phototransistors 202, 203 in the light-receiving unit. The variable resistor 809 is connected to the phototransistor 202, and the variable resistor 810 is connected to the phototransistor 203. Photosensitivity is capable of being adjusted by changing the resistance value of the respective variable resistor. Further, a resistor 811 is for limiting the driving current of the LED 201.

The sensitivities of the phototransistors 202, 203 in the light-receiving unit are adjusted in advance by adjusting the resistance values of the variable resistors 809 and 810. The resistance value of the variable resistor 808 is used to set threshold values in a manner similar to that of the third embodiment.

Furthermore, output voltages obtained by reading the variable resistors 809, 810 by the main control unit 305 of the image forming apparatus can be used to compute a value indicating glossiness of the printing medium and a value indicating light transmittance of the printing medium for the purpose of determining the type of printing medium. The type of printing medium is determined based upon the computed values.

It should be noted that although a ratio, which is a value (threshold value) indicative of transmittance of the printing medium, between a specular-transmission output and a diffuse-transmittance output is fixed in the foregoing description, as illustrated in FIG. 11, the value indicative of transmittance can also be set in accordance with the resistance value of a variable resistor. In this case, threshold values can be set by several combinations of a value (threshold value) indicating glossiness and a value (threshold value) indicating transmittance.

Figure 14:
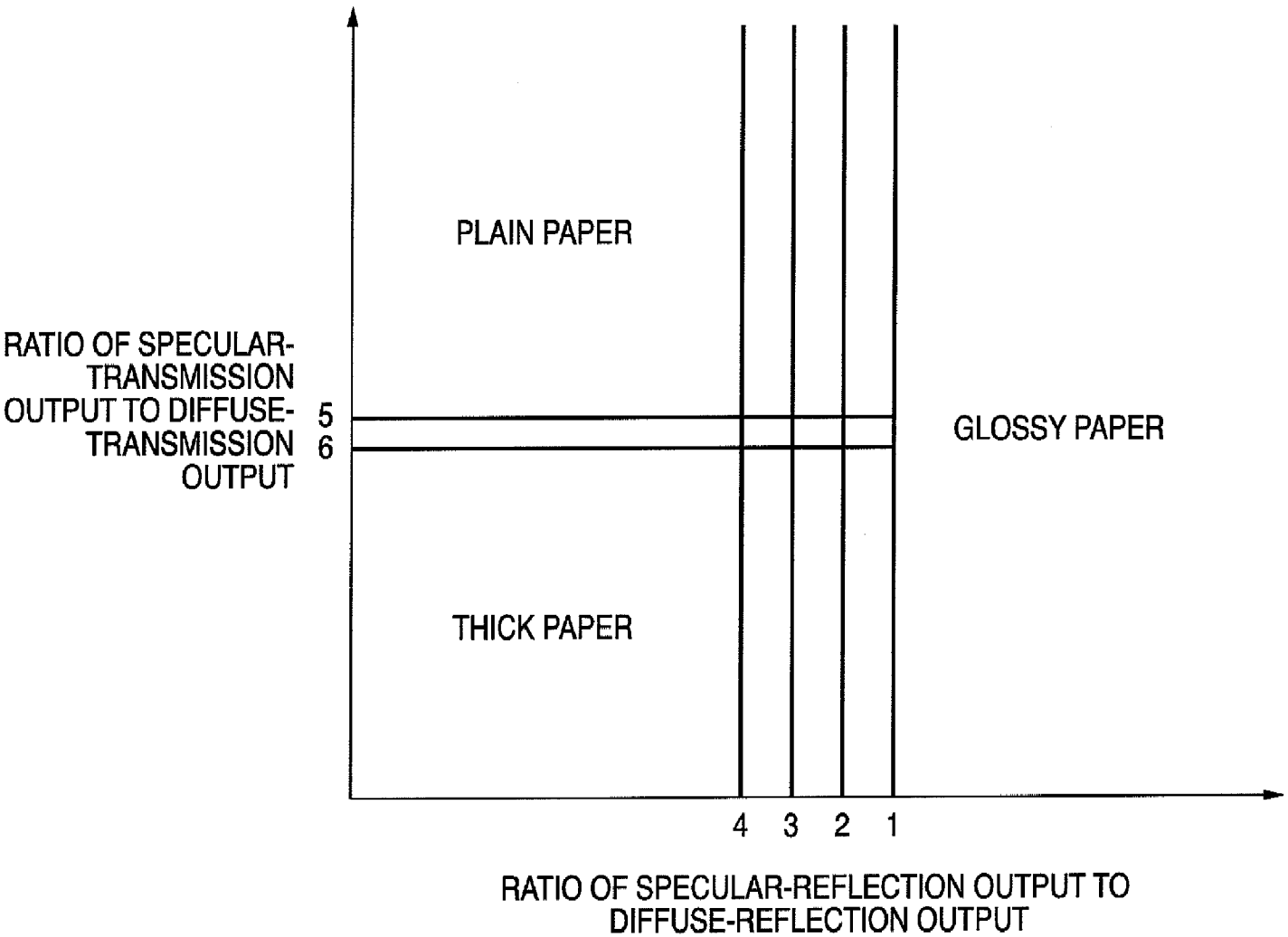
FIG. 14 is a diagram illustrating threshold values for determining types of printing media according to an embodiment.

For example, as illustrated in FIG. 14, values of two types (5 and 6 in FIG. 14) can be set as values indicating transmittance threshold values and threshold values of several patterns can be set by combining these values with values indicative of glossiness. In this case, the resistance value of the variable resistor can be set to, for example, 0 V to 3.0 V, thereby broadening the width of the voltage values set and increasing the number of combinations.

Furthermore, it is also possible to determine whether or not the intermediate transfer unit is present or not based upon the resistance value of the variable resistor 808. In the first embodiment, whether or not the intermediate transfer member unit is present is sensed (determined) using the new-product sensing fuse. However, such a fuse need not be used. For example, if the resistance value of the variable resistor is outside a range of settings of threshold values, that is, if the resistance value is greater than a maximum resistance value (1.5 V or 3.0 V in the description above), then it can be determined that the intermediate transfer member unit is absent. Conversely, if the resistance value is within the range of settings of threshold values, then it can be determined that the intermediate transfer member unit is present. Further, as for the timing for determining whether or not the intermediate transfer member unit is present, this is set to a timing at which it is likely that the intermediate transfer member unit will be replaced, such as the time at which a power switch is turned on or the time at which the door of the image forming apparatus is closed.

Other Embodiments

In the foregoing embodiments, output correction (calibration) regarding the printing-medium-permeating light LED 118 has not been described. However, this output correction can be performed in a manner similar to that of the foregoing embodiments. Specifically, the LED 118 can be made to emit light at a prescribed timing and the output values from the phototransistors 202, 203 can be stored in the memory 308 or 608. The prescribed timing is the time the apparatus is shipped from the factory or a time prior to feeding of the printing medium up to the printing-medium determination sensor 117 following the acceptance of a print job by the image forming apparatus.

Further, in the description of the foregoing embodiments, the main body 100 of the image forming apparatus is equipped with the printing-medium-permeating light LED 118. However, the present invention is not limited to this arrangement. Specifically, in an image forming apparatus in which the printing-medium-permeating light LED 118 also is contaminated with paper dust or toner, the intermediate transfer member unit 300 or another consumable unit different from the intermediate transfer member unit 300 may be equipped with the printing-medium-permeating light LED 118. This would make it possible to maintain a separate accuracy from the start of use to end of product lifetime also with regard to thickness and grammage among the types of printing medium.

Further, although the printing-medium determination sensor 117 of the foregoing embodiments has one light-emitting element and two light-receiving elements, the present invention is not limited solely to this arrangement. Specifically, the printing-medium determination sensor 117 may comprise a CMOS sensor or CCD sensor. In a case where a CMOS sensor or CCD sensor is used, the surface property of a printing medium can be discriminated by reading a two-dimensional image and then processing the resultant data.

In the foregoing embodiments, an example in which the printing-medium determination sensor 117 is mounted on the intermediate transfer member unit 300 is described. However, the present invention is not limited to this arrangement. That is, the printing-medium determination sensor 117 may just as well be mounted on another consumable unit that is replaced at a cycle shorter than the product lifetime of the main body of the image forming apparatus.

Besides the intermediate transfer member unit mentioned above, units such as a cartridge having a photosensitive body or a developing unit, and an electrostatic adsorption belt unit for conveying a printing medium while causing it to be attracted thereto, are examples of consumable units to which the present invention is applicable. With such a unit installed in the main body of the image forming apparatus, the printing-medium determination sensor provided on the unit is placed at a position in close proximity to a conveyance path of the printing medium. In other words, if it is possible to place the printing-medium determination sensor at a position close to the conveyance path of the printing medium, then the present invention is applicable to units other than the units mentioned above.

In the embodiments described above, the reflected-light LED 201 and the phototransistors 202, 203 are all attached to the intermediate transfer member unit 300. However, the LED and the phototransistors need not necessarily be attached to the intermediate transfer member unit 300. That is, if at least the light-emitting element for irradiating the printing medium with light or the light-receiving elements that receive light from the printing medium is/are attached to the consumable unit, then discrimination accuracy can be maintained at a level higher than that in the prior art.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-089049, filed Mar. 29, 2007, and 2008-056627, filed on Mar. 6, 2008, which are hereby incorporated by reference herein in their entirety.

What is claimed is:

1. An image forming apparatus comprising:

a sensor which senses type of printing medium;

an image forming unit which forms an image on an image carrier;

an intermediate transfer member to which the image that has been formed on the image carrier is transferred by primary transfer;

a secondary transfer member which transfers the image that has been formed on said intermediate transfer member to the printing medium by secondary transfer;

a fixing unit which fixes the image to the printing medium by applying heat and pressure to the printing medium to which the image has been transferred by secondary transfer; and a controller which sets fixing conditions in said fixing unit in accordance with the type of printing medium sensed by said sensor;

wherein said intermediate transfer member and sensor are configured as an intermediate transfer member unit and are removably installed in a main body of the image forming apparatus; and said intermediate transfer member unit has a storage unit which stores information used to determine the type of printing medium by said sensor.

2. The apparatus according to claim 1, wherein said storage unit includes a resistor which holds the information as a resistance value; and said controller sets a threshold value, which is for determining the type of printing medium using said sensor, in accordance with the resistance value.

3. The apparatus according to claim 1, wherein said sensor includes:

a light-emitting unit which irradiates the printing medium with light; and a light-receiving unit which receives light from the printing medium;

said storage unit includes a resistor capable of being set to a resistance value; and photosensitivity of said light-receiving unit or quantity of light emitted by said light-emitting unit is set in accordance with the resistance value.

4. The apparatus according to claim 1, further comprising a light-emitting unit, which is used in order to sense thickness or grammage of the printing medium, provided on a side opposing said sensor with a conveyance path of the printing medium interposed therebetween; and said light-emitting unit is provided on the main body of the image forming apparatus.

5. A unit removably installed in an image forming apparatus, comprising:

an intermediate transfer member to which an image that has been formed on an image carrier is transferred by primary transfer;

a sensor which senses the type of the printing medium; and a storage unit which stores information for determining the type of printing medium using said sensor.

6. The unit according to claim 5, wherein said storage unit includes a resistor which holds the information as a resistance value; and a controller of the image forming apparatus sets a threshold value, which is for determining the type of printing medium, in accordance with the resistance value.

7. The unit according to claim 5, wherein said sensor includes:

a light-emitting unit which irradiates the printing medium with light; and a light-receiving unit which receives light from the printing medium;

said storage unit includes a resistor capable of being set to a resistance value; and photosensitivity of said light-receiving unit or quantity of light emitted by said light-emitting unit is set in accordance with the resistance value.

8. The unit according to claim 5, further comprising a collecting unit which collects a developer remaining on said intermediate transfer member.

* * * * *